United States Patent [19]

Raptis

[11] 4,089,201

[45] May 16, 1978

[54] SILENT DENT PULLER

[76] Inventor: Constantine Raptis, Box 14, Middlesex Rd., Tyngsboro, Mass. 01879

[21] Appl. No.: 690,711

[22] Filed: May 27, 1976

[51] Int. Cl.[2] ..... B21D 1/12

[52] U.S. Cl. ..... 72/390; 72/705

[58] Field of Search ..... 72/390, 705, 389

[56] References Cited

U.S. PATENT DOCUMENTS

| | | | |
|---|---|---|---|
| 1,822,407 | 9/1931 | Kennedy | 72/705 X |
| 2,528,361 | 10/1950 | Hauschild | 72/705 |
| 2,543,347 | 2/1951 | Bartlo | 72/705 X |
| 2,696,240 | 12/1954 | Crowder | 72/705 X |
| 2,799,190 | 7/1957 | Awot | 72/705 X |
| 2,863,489 | 12/1958 | Priest | 72/705 X |
| 2,949,144 | 8/1960 | Dredske et al. | 72/705 X |
| 3,187,538 | 6/1965 | Painter | 72/705 X |
| 3,977,230 | 8/1976 | Jones | 72/705 X |
| 4,000,639 | 1/1977 | Postema | 72/390 X |

*Primary Examiner*—C.W. Lanham
*Assistant Examiner*—D. M. Gurley
*Attorney, Agent, or Firm*—Pearson & Pearson

[57] ABSTRACT

A dent puller tool has a bracing frame which straddles a small dent, which may even be curved. An exteriorly threaded turn rod has a puller tip for penetrating a drilled hole and pulling out the dent. The tool includes a hollow, tubular guide shaft, threadedly adjustable longitudinally in the frame, and the turn rod is freely movable therein. The guide shaft is adjusted to locate its lower rim as a stop for the puller tip at the desired level when a winged nut, threaded on the rod, is turned against the upper rim of the guide shaft. A separable elongated frame-like base extension receives the base of the frame for straddling large dents and serving as a pull stop therefor.

8 Claims, 5 Drawing Figures

Fig. 1
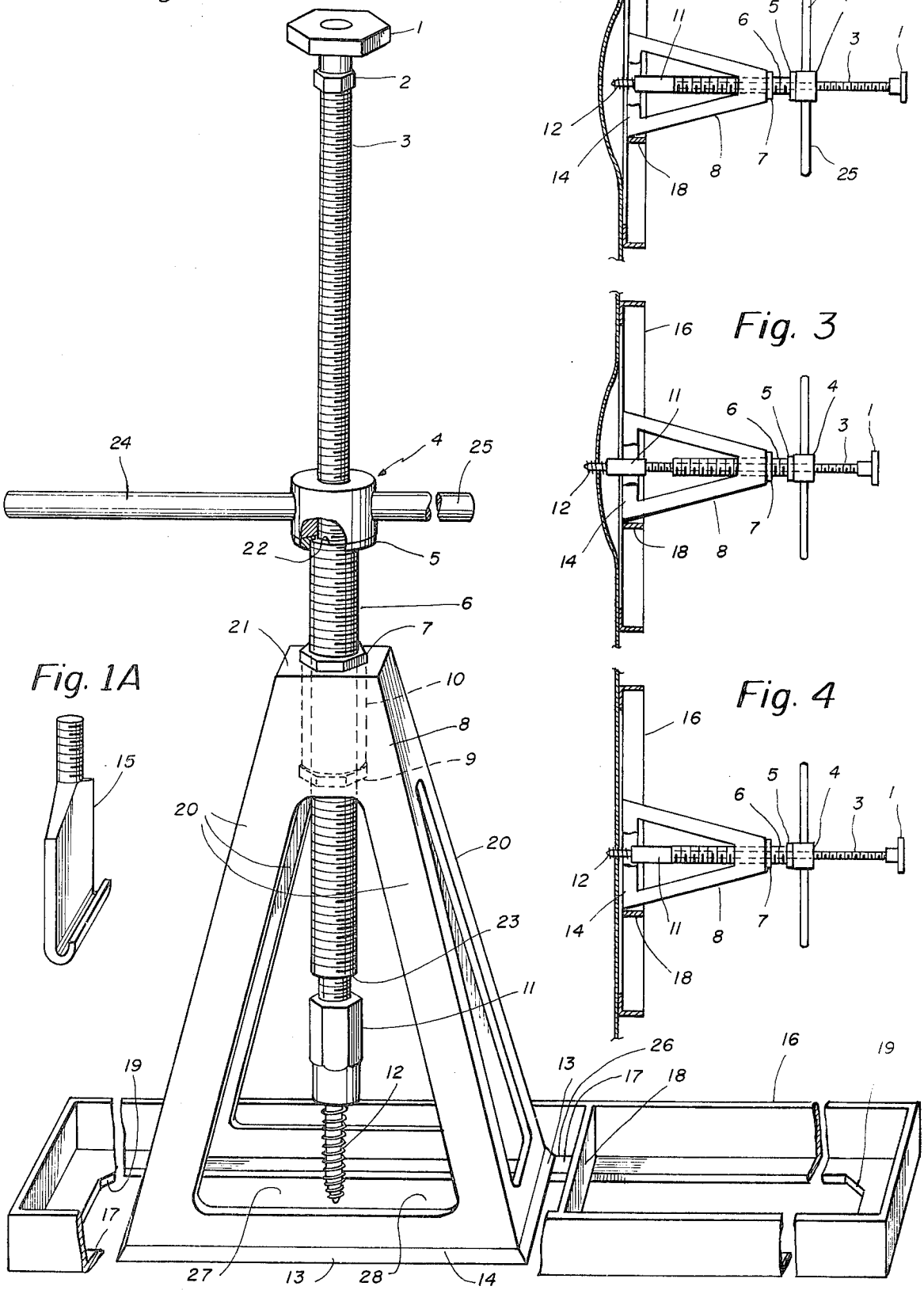
Fig. 1A
Fig. 2
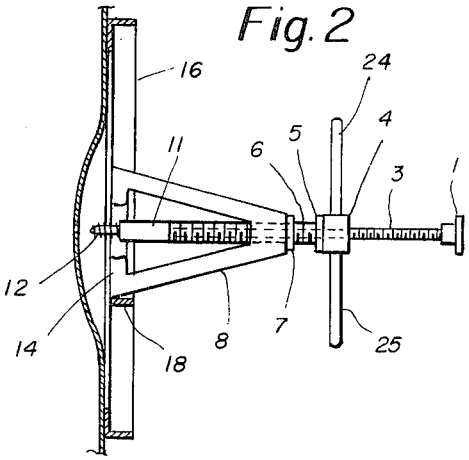
Fig. 3
Fig. 4

SILENT DENT PULLER

BACKGROUND OF THE INVENTION

It has heretofore been proposed to provide a dent puller consisting of an upstanding frame having a base which straddles the dent and having a pull rod which is moved outwardly by a lever type handle as in U.S. Pat. No. 3,977,230 to Jones of Aug. 31, 1976 or U.S. Pat. No. 2,949,144 to Dredske of Aug. 16, 1960.

It has also been proposed to withdraw a pull rod in such a frame by means of a crank as in U.S. Pat. No. 3,187,538 to Painter of June 8, 1965 or U.S. Pat. No. 2,696,240 to Crowder of Dec. 7, 1954.

In U.S. Pat. No. 2,883,489 to Priest of Dec. 9, 1958 a foldable frame having spaced base plates is disclosed, there being a threaded pull rod keyed against rotation in the apex of the frame but having a threaded crank wheel for withdrawing the pull rod.

SUMMARY OF THE INVENTION

In this invention the upstanding frame has four spaced legs integral with a base of rectangular cross-section, the apex having a guide shaft which is longitudinally adjustable in height relative to the apex. The threaded pull rod floats in the guide shaft, in that it is freely rotatable and freely reciprocable therein. The pull rod is withdrawn by the turning of a winged nut on the threaded pull rod, there being a lipped bushing contacting the adjacent surface of the guide shaft. Rather than depending on extensible pivoted legs for straddling large dents, this invention provides an elongated base extension in which the rugged, unitary bracing frame fits to thereby straddle a large dent.

BRIEF DESCRIPTION OF THE DRAWINGS

FIG. 1 is a perspective view of a dent puller of the invention;

FIG. 1A is an enlarged perspective view of a pull hook;

FIG. 2 is a schematic side elevation on a reduced scale showing the guide shaft adjusted to locate the pull tip at the desired level;

FIG. 3 is a view similar to FIG. 2, showing the pull rod freely advanced in the tubular guide shaft to cause the tip to engage in the hole in the dent; and FIG. 4 is a view similar to FIGS. 2 and 3 showing the winged nut turned against the guide shaft on the rod to draw the dent out to the level set by the adjustable guide shaft.

DESCRIPTION OF A PREFERRED EMBODIMENT

The dent puller, as shown in the accompanying drawing (FIG. 1) together with the extension bracket 16 weighs approximately 7 pounds. Except for the pull rod 3, guiding shaft 6, puller tip 12 and puller hook 15, the tool can be made of light metal or aluminum. The parts excepted would be made of steel.

As shown in FIG. 1, the bracing frame 8, with the pull rod 3 stands 18¾ inches high. The hollow rectangular base 14 of the bracing frame 8 is seven inches square and the four integral legs 20 are about 9¼ inches high. The top 21 of the bracing frame 8 is ¾ inches square. A guiding shaft collar 10, approximately 2 inches long is molded to the neck of the bracing frame. A nut 7 is recessed into the frame on top of the collar and the hollow tubular guiding shaft 6, which is eight inches long, is threaded through this nut. A lock nut 9, which is threaded through the guiding shaft underneath, locks the guiding shaft to the collar.

A threaded pull rod 3 passes through the guiding shaft 6 as shown in FIG. 1. This pull rod 3 is one-half inch in diameter and approximately 17 inches long. The length may vary and it will not hinder the operation of the tool. At the base of the pull rod 3 there is a 1¾ inch long chuck 11 into which is threaded a tapered pull tip 12. The pull tip 12 is in turn threaded at its base, one-half inch to zero. The pull tip 12 can be replaced with the puller hook 15 shown in FIG. 1A for contouring fender wells in auto body repair work.

A lipped bushing 5 is threaded on top of the guiding shaft 6, the upper annular rim of the guide shaft being designated 22 and the lower annular rim of the guide shaft, which contacts the chuck 11, being designated 23. A winged nut 4 with 6 inch handles 24 and 25 on either side forming the wings is threaded on the pull rod 3. A grip handle or knob 1 is threaded at the top of the pull rod 3 and is secured by a lock nut 2 (FIG. 1).

As shown in FIG. 1, the bracing frame, or stand, 8 includes a base 14 of rectangular cross-section having flanges, or fins 13 which project outwardly on the periphery of at least two and preferably on all four sides.

The extension bracket 16 is elongated and includes longitudinally extending ribs 17 in the central section which form channels 26 therebelow for slidably receiving and retaining the flanges 13 of the bracing frame, up to the transversely extending stop bar 18. Corner supports 19 strengthen the extension bracket 16.

OPERATION OF THE INVENTION

The tool is used for the purpose of pulling out dents in various types of sheet metal. It is especially useful wherever auto body repairs are done.

The damaged or dented area is first prepared by drilling several holes to accept the tapered pull tip 12. The bracing frame 8 is placed over the dented area (with or without the extension bracket 16 depending on the size of the damaged area). The hollow tubular guide shaft 6 is then turned in the threaded collar 10 until the lower annular rim 23 is correctly positioned to engage the chuck 11 with the pull tip 12 of the freely slidable pull rod 3 at the desired level to which the dent is to be straightened. (FIG. 2) The skeletonized framelike extension 16 thus serves as a stop for pulling out large area dents and the tubular guide shaft 6 serves as a stop for pulling out small area dents, even on curved surfaces without danger of over pulling. The winged nut 4 is then rotated counter clockwise to move it outwardly on pull rod 3. (not shown) The grip handle 1, and turn rod 3, are then slidably advanced in the guide shaft (FIG. 3) up to the dent and the rod is then turned clockwise extending the pull tip 12 until the pull tip 12 screws into the holes already drilled. After the pull tip 12 is secured, holding the grip handle with one hand, the winged nut dual handle 4 is turned clockwise. Upon contact with the lipped bushing 5 or with the annular upper rim 22 of the guide shaft 6, each subsequent turn of the dual handles will cause the pull rod 3 to lift out of the guide shaft. At the same time, the pull tip 12, attached to the pull rod 3, will be pulling the dent outward. The dual handles are rotated until the pull tip 12 lifts the dented area to the desired level defined by the annular lower rim 23 of the guide shaft and/or the extension bracket 16. The pull tip 12 is then released by turning the grip handle 1 to the left and unscrewing it from the drilled hole. This procedure is repeated until all of the dented area is pulled to the desired level and is ready for grinding and filling. It should be noted that the skeletonized, frame-like base extension 16 defines an elongated hollow rectangular figure the central portion 27 thereof registering with the corresponding hollow FIG. 28 defined by the hollow frame-like base 14.

I claim:

1. In a dent puller the combination of:

bracing frame means having a lower base defining a hollow figure with integral peripheral, outwardly projecting flanges and an upper interiorly threaded collar;

an exteriorly threaded guide shaft adjustable in said collar and having an annular, lower rim;

elongated base extension means having ribs and channels for slidably receiving said flanges, said means defining a hollow figure registering with the hollow figure of said frame means;

pull rod means rotatable and freely slidable in said guide shaft, said pull rod means including a threaded pull rod and a pull rod chuck having a pull tip therewithin; and winged nut means threaded on said pull rod, outside said guide shaft for retracting said pull rod chuck and pull tip the lower rim of said guide shaft serving as a stop for said chuck in the pulling of small area dents and said base extension means serving as a bridge over large area dents.

2. In a dent puller the combination of:

a bracing frame having a flat base defining a hollow rectangle for straddling a dent, legs upstanding from said base and terminating in an interiorly threaded bracing frame collar;

an elongated, hollow, tubular guide shaft exteriorly threaded in said collar, said shaft having an upper annular rim and a lower annular rim; and being longitudinally adjustable in said collar to position said lower annular rim at selected heights relative to said base;

an exteriorly threaded, elongated pull rod freely rotatable and reciprocable in said hollow, tubular guide shaft, said rod having a grip handle at its upper end and a chuck at its lower end said chuck having a pull tip mounted therein;

and a winged nut interiorly threaded on said pull rod between said grip handle and the upper annular rim of said guide shaft said chuck engaging said lower annular rim of said guide shaft when said pull tip is at the desired level to which the dent is to be pulled for preventing over pull.

3. A dent puller as specified in claim 2 wherein:

said tubular guide shaft includes a top guide shaft lock nut and a bottom guide shaft lock nut for locking said shaft in said collar.

4. A dent puller as specified in claim 2 wherein:

said pull tip is a helically threaded, tapered screw adapted to enter a drill hole and engage the rim of the hole when said handle and pull rod are rotated.

5. A dent puller as specified in claim 2 wherein:

said winged nut includes a pair of elongated rods each on an opposite side thereof and forming the wings of said nut.

6. A dent puller as specified in claim 2 wherein:

a lipped bushing is mounted between said winged nut and upper annular rim of said guide shaft.

7. A dent puller as specified in claim 2 including:

an elongated skeletonized, frame-like base extension;

and cooperable rib and channel means on said base extension and flange means on said base for slideably retaining said base in said extension said base extension defining a hollow figure and being adapted to bridge large area dents.

8. A dent puller as specified in claim 7 wherein:

said cooperable rib and channel means comprises outwardly projecting, flanges on at least two opposite sides of said base and inwardly projecting ribs on said base extension, said flanges being slidably received in channels formed by said ribs.

* * * * *